US008162008B1

(12) United States Patent
Presnell, III

(10) Patent No.: US 8,162,008 B1
(45) Date of Patent: Apr. 24, 2012

(54) METHOD AND SYSTEM FOR PRODUCING SIMULATED HAND-WOVEN RUGS

(76) Inventor: Samuel C. Presnell, III, Cincinnati, OH (US)

( * ) Notice: Subject to any disclaimer, the term of this patent is extended or adjusted under 35 U.S.C. 154(b) by 198 days.

(21) Appl. No.: 12/731,351

(22) Filed: Mar. 25, 2010

Related U.S. Application Data

(60) Provisional application No. 61/169,894, filed on Apr. 16, 2009.

(51) Int. Cl.

| | |
|---|---|
| ***D03D 39/20*** | (2006.01) |
| ***D03D 39/24*** | (2006.01) |
| *D03D 39/00* | (2006.01) |
| *D03D 31/00* | (2006.01) |

(52) U.S. Cl. ..... 139/21; 139/116.5; 139/116.6; 139/391; 139/392

(58) Field of Classification Search ..... None
See application file for complete search history.

(56) References Cited

U.S. PATENT DOCUMENTS

| | | | | | |
|---|---|---|---|---|---|
| 378,884 | A | * | 3/1888 | Hall | 112/9 |
| 1,418,512 | A | * | 6/1922 | Bachofen | 139/116.6 |
| 1,691,194 | A | * | 11/1928 | Howard | 139/37 |
| 1,691,195 | A | * | 11/1928 | Howard | 139/21 |
| 1,827,614 | A | * | 10/1931 | Riviere | 112/410 |
| 1,857,067 | A | * | 5/1932 | Seiler | 112/9 |
| 1,970,443 | A | * | 8/1934 | Cooper et al. | 139/21 |
| 2,060,502 | A | * | 11/1936 | Kaufman | 139/398 |
| 2,108,046 | A | * | 2/1938 | Drobile | 139/397 |
| 2,108,288 | A | * | 2/1938 | Kubicky | 139/397 |
| 2,199,515 | A | | 5/1940 | Woods | |
| 2,450,067 | A | * | 9/1948 | Wolff | 66/4 |
| 2,474,904 | A | | 7/1949 | Mazzella | |
| 2,491,258 | A | * | 12/1949 | Fuhrhop et al. | 156/72 |
| 2,759,495 | A | * | 8/1956 | Masland | 139/39 |
| 2,981,292 | A | * | 4/1961 | Hoeselbarth | 139/39 |
| 3,060,974 | A | * | 10/1962 | Hoffman | 139/43 |
| 3,289,706 | A | * | 12/1966 | Valentine | 139/21 |
| 3,602,011 | A | * | 8/1971 | Barton et al. | 66/85 A |
| 3,636,988 | A | * | 1/1972 | Troy et al. | 139/46 |
| 3,677,206 | A | * | 7/1972 | MacIsaac, Jr. et al. | 112/80.52 |
| 3,710,592 | A | * | 1/1973 | Scow | 28/149 |
| 3,722,442 | A | * | 3/1973 | MacIsaac, Jr. et al. | 112/410 |
| 3,827,091 | A | * | 8/1974 | Hocevar | 66/1 A |
| 3,831,232 | A | * | 8/1974 | Bondi | 28/160 |
| 3,922,804 | A | * | 12/1975 | Batey | 38/102.91 |
| 4,102,065 | A | * | 7/1978 | Selden | 38/102.1 |

(Continued)

*Primary Examiner* — Bobby Muromoto, Jr.
(74) *Attorney, Agent, or Firm* — Wood, Herron & Evans, LLP

(57) ABSTRACT

A rug, a loom for making a rug and a method of making a rug are various aspects of this invention. The loom for weaving a rug includes a frame defining a workspace for weaving the rug in which the frame includes a first, a second and a third frame member with a number of warp yarns extending across the workspace. Each of the warp yarns is coupled to the third frame member and a first set of the warp yarns is coupled to the first frame member and a second set of the warp yarns is coupled to the second frame member. The loom also includes at least one rod adapted to extend within the workspace to receive a first yarn pile thread looped thereon and about the first set of warp yarns to form a first yarn pile. The rod also receives a second yarn pile thread looped thereon and about the second set of warp yarns to form a second yarn pile. A method of making a rug as well as a rug itself is a further aspect of this invention.

16 Claims, 8 Drawing Sheets

U.S. PATENT DOCUMENTS 4,192,159 A * 3/1980 Kohl ..... 66/203
4,275,515 A * 6/1981 Hinson ..... 38/102.91
4,375,197 A * 3/1983 Hinson ..... 112/475.23
4,406,309 A * 9/1983 Czelusniak, Jr. ..... 139/402
4,417,409 A * 11/1983 Bell ..... 38/102.91
5,154,208 A * 10/1992 Carlos ..... 139/37
5,293,704 A * 3/1994 Brown ..... 38/102.9
5,343,600 A 9/1994 Peykar
5,575,228 A * 11/1996 Padgett et al. ..... 112/80.41
5,605,107 A * 2/1997 Padgett et al. ..... 112/475.23
6,165,584 A 12/2000 Bryant
6,269,759 B1 * 8/2001 Zafiroglu et al. ..... 112/80.01
6,817,383 B2 * 11/2004 Debaes et al. ..... 139/21
6,951,590 B2 * 10/2005 Zafiroglu et al. ..... 156/72
7,128,096 B2 * 10/2006 Debaes et al. ..... 139/46
7,134,401 B2 * 11/2006 Debaes et al. ..... 116/21
7,451,786 B2 * 11/2008 Debaes ..... 139/21
7,926,518 B2 * 4/2011 Debaes et al. ..... 139/291 C
2003/0070739 A1 * 4/2003 Zafiroglu et al. ..... 156/93
2003/0082334 A1 * 5/2003 Zafiroglu ..... 428/85
2003/0226613 A1 * 12/2003 Debaes et al. ..... 139/408
2005/0166989 A1 * 8/2005 Debaes et al. ..... 139/116.2
2007/0048491 A1 * 3/2007 Couri et al. ..... 428/97

* cited by examiner

METHOD AND SYSTEM FOR PRODUCING SIMULATED HAND-WOVEN RUGS

This claims the benefit of U.S. Provisional Patent Application Ser. No. 61/169,894, filed Apr. 16, 2009 and hereby incorporated by reference in its entirety.

BACKGROUND OF THE INVENTION

Genuine, hand-knotted oriental rugs are often considered a true work of art. While China and India produce many of the newer rugs in the American market, Iran and the Caucasus mountain range of the southern Soviet Union was at one time the leading rug weaving regions of the world. Hand-knotted rugs have been around almost as long as colonized human civilizations and many of the rugs woven today are made in a similar manner. There are many reasons oriental rugs are so expensive compared to a machine-made rug, and the quality and value of a genuine rug far surpass those of lesser rugs.

Genuine oriental rugs are woven by hand on a loom, which can be adapted and will be a little larger than the size of the rug being woven. The warp strings, or the strings that stretch lengthwise on the loom, are an important part of the foundation of the rug. These strings are usually cotton because the wool used in creating the pile of the rug will draw tightly and adhere to the cotton when tied.

Textile weaving is an ancient art. In early times as well as now, a large number of warp threads or yarns are supported on a loom at spaced locations across the width of the fabric to be woven. A shuttle passes laterally through the warp yarns carrying a weft yarn. Multiple passes of the shuttle creates a woven fabric wherein each weft yarn weaves through the warp yarns.

When the warp of the rug-to-be is secure, the weaver will begin tying the actual knots that will create the soft pile of the rug. He will use a carefully designed drawing of the rug that has been colored onto a grid. Each square in the grid represents a knot, and the colored designs on his drawing let him know when to change colors of wool being used. He will begin by tying a knot using wool thread around two of the warp strings, sliding it down to the base of the warp strings tightly, and he then will cut the excess thread with a knife. He will continue doing this all the way across the base of the warp until a complete row of knots has been woven. The weaver will then guide another single string called a weft across the warp, and beat it tightly down upon the row of knots he has woven with a heavy metal comb. This assures that the rug will remain taught and even throughout the entire weaving process.

Once a horizontal row has been created, the weaver will begin a new row and follow the colored drawing of the rug to know when to use a new color. An efficient weaver may tie well over one hundred knots in about five minutes or so. But the entire process of creating just one row of knots can take many hours, especially if the rug is large. This weaving goes on hour after hour and day after day until the rug is complete, which may be a significant amount of time. For instance, a 6'×9' rug may take four to six months to complete, so the labor is very intense.

Other types of yarns may also be joined to the warp yarns. In the ancient art of Oriental rug weaving, pile yarns are manually tied or otherwise joined to the warp yarns according to a certain scheme. For example, two weft yarns may be interwoven with the warp yarns, and then individual pile yarns may be tied to adjacent pairs of warp yarns using a particular knot. Two more weft yarns may then be interwoven before the next row of pile yarns is tied. Other schemes may also be used. In woven fabrics in general, yarns which are interwoven with or joined to the warp yarns are collectively known as "filling" yarns. When the fabric is an oriental rug, the filling yarns include the weft yarns and the pile yarns.

In order to weave a relatively dense fabric, the filling yarns must be compressed tightly against the already woven portion of the fabric. This is accomplished by using a comb-like structure or "reed" having teeth or "dents" which are spaced apart so as to fit between adjacent warp yarns. The teeth of the reed are urged against the filling yarns to compress them against the woven portion of the fabric. This process is known as "beating up" the filling yarns against the "fell" of the fabric.

There are numerous methods and looms for forming patterned rugs or carpets, woven or tufted, of different designs in which various areas of the rug have different characteristics. Different colored patterns may be formed in pile rugs by utilizing different colored yarns in different areas. Special looms with Jacquard or Dobby attachments, or tufting machines with pattern drums or other types of pattern controls, may be utilized for forming pile rugs having different patterns, distinguished by color, texture, pile height, yarn material, cut or uncut loops, or other characteristics.

When the rug has been completely woven, it is cut from the loom and scrutinized very carefully for flaws. The fringes often seen at the ends of the rug are the actual ends of the warp strings, and may sometimes be braided by the weaver. If the rug has been successfully woven, it is then fine-tuned. Other workers in the rug trade will make sure the pile of the rug is completely even, and will trim any areas of the pile that may need it. The rug is then lightly washed in water to thoroughly clean its surfaces, and to bleed any excess dye from the wool used in making the rug. Some rugs are "tea washed" after they have been woven in a mixture of tea like colorings, which will slightly dye the whole rug and give it a more mellow color overall. Excess water is then extracted from the rug, and it is allowed to dry thoroughly to avoid creating a rot in the rug.

An authentic oriental rug is a handmade carpet that is either knotted with pile or woven without pile. While each of these techniques has met with some success, the techniques to determine the pattern are quite complex and labor intensive, so the finished products tend to be expensive.

Today the high-end rugs from Nepal, China and India are becoming more in vogue. These rugs are unique in the sense that they are hand-woven using part of the design with pile or loop and the field being flat woven with an appearance like the Somack or Tapestry weaves. This type of weaving gives the pattern of an embossed or raised effect. The price for this look is approximately $12.00 to $50.00 per square foot wholesale, depending on the weave and materials used. This type of rug would have a retail price of $25.00 to $100.00 per square foot. The current cost of this style and other styles of hand woven rugs puts them out of range for most buyers. Therefore, a need exists for a high quality rug that can be produced efficiently at lower costs while still offering the quality associated with known rugs.

SUMMARY OF THE INVENTION

These and other objectives have been attained with the various embodiments of this invention which include a rug, a loom for making a rug and a method of making a rug. In one embodiment, this invention is a loom for weaving a rug including a frame defining a workspace for weaving the rug in which the frame includes a first, a second and a third frame member adapted to have a number of warp yarns extending across the workspace. Each of the warp yarns is coupled to the third frame member and a first set of the warp yarns is coupled to the first frame member and a second set of the warp yarns is coupled to the second frame member. The first and second frame members are spaced from and on an opposite end of the workspace from the third frame member. The loom also includes at least one rod adapted to extend within the workspace and generally parallel to the first, second and third frame members and across the warp yarns between the third frame member and the first and second frame members. The rod receives a first yarn pile thread looped thereon and about the first set of warp yarns to form a first yarn pile. The rod also receives a second yarn pile thread looped thereon and about the second set of warp yarns to form a second yarn pile.

In other embodiments of this invention, the frame defines a workspace plane and the first and second frame members are offset from one another in a direction generally perpendicular to the workspace plane within the frame to differentiate the first and second set of warp yarns. A cutter is used to sever the first and second yarn pile threads looped around the rod to form the first and second piles, respectively. In alternate embodiments, different rods having at least one characteristic different from the original rod can be used so as to form the second and subsequent piles with a characteristic different from the first pile.

Another aspect of this invention is a method of making a rug beginning with arranging each of a plurality of first warp yarns in a first set of warp yarns in a longitudinal direction and arranging each of a plurality of second warp yarns in a second set of warp yarns in the longitudinal direction. Then a rod is positioned laterally relative to the first and second sets of warp yarns and a first yarn pile thread is weaved around the first rod and each of the first warp yarns in the first set and then a first weft yarn is weaved in a lateral direction adjacent to the first yarn pile. The first weft yarn is then forced toward or beaten against the first yarn pile thread. The first yarn pile thread is then cut along the first rod to form a first yarn pile.

Subsequently in one embodiment a second rod is positioned laterally relative to the first and second sets of warp yarns and a second yarn pile thread is weaved around the second rod and each of the second warp yarns in the second set. A second weft yarn is then weaved in the lateral direction adjacent to the second yarn pile thread relative to each of the second warp yarns in the second set of warp yarns and each of the first warp yarns in the first set of warp yarns. The second weft yarn is then forced toward the second yarn pile thread and the second yarn pile thread is cut along the second rod to form a second yarn pile. These steps are repeated until the rug is completed.

A further aspect of this invention is a rug in one embodiment. The rug includes a first plurality of warp yarns in a first set of warp yarns each extend longitudinally on the rug and a second plurality of warp yarns in a second set of warp yarns also each extend longitudinally on the rug. The yarns in the first set of warp yarns alternate in a lateral direction with the yarns in the second set of warp yarns. A first plurality of weft yarns in a first set of weft yarns each extend laterally on the rug and are juxtaposed atop the first set of warp yarns and beneath the second set of warp yarns. A second plurality of weft yarns in a second set of weft yarns each extend laterally on the rug and are juxtaposed beneath the first set of warp yarns and atop the second set of warp yarns. The yarns in the first set of weft yarns alternate in a longitudinal direction with the yarns in the second set of weft yarns. A first plurality of yarn pile threads are each tied to one of the yarns in the first set of warp yarns and a second plurality of yarn pile threads are each tied to one of the yarns in the second set of warp yarn. The threads in the first plurality of yarn pile threads alternate in a longitudinal direction with the threads in the second plurality of yarn pile threads to form one embodiment of the rug according to this invention.

BRIEF DESCRIPTION OF THE DRAWINGS

The various features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
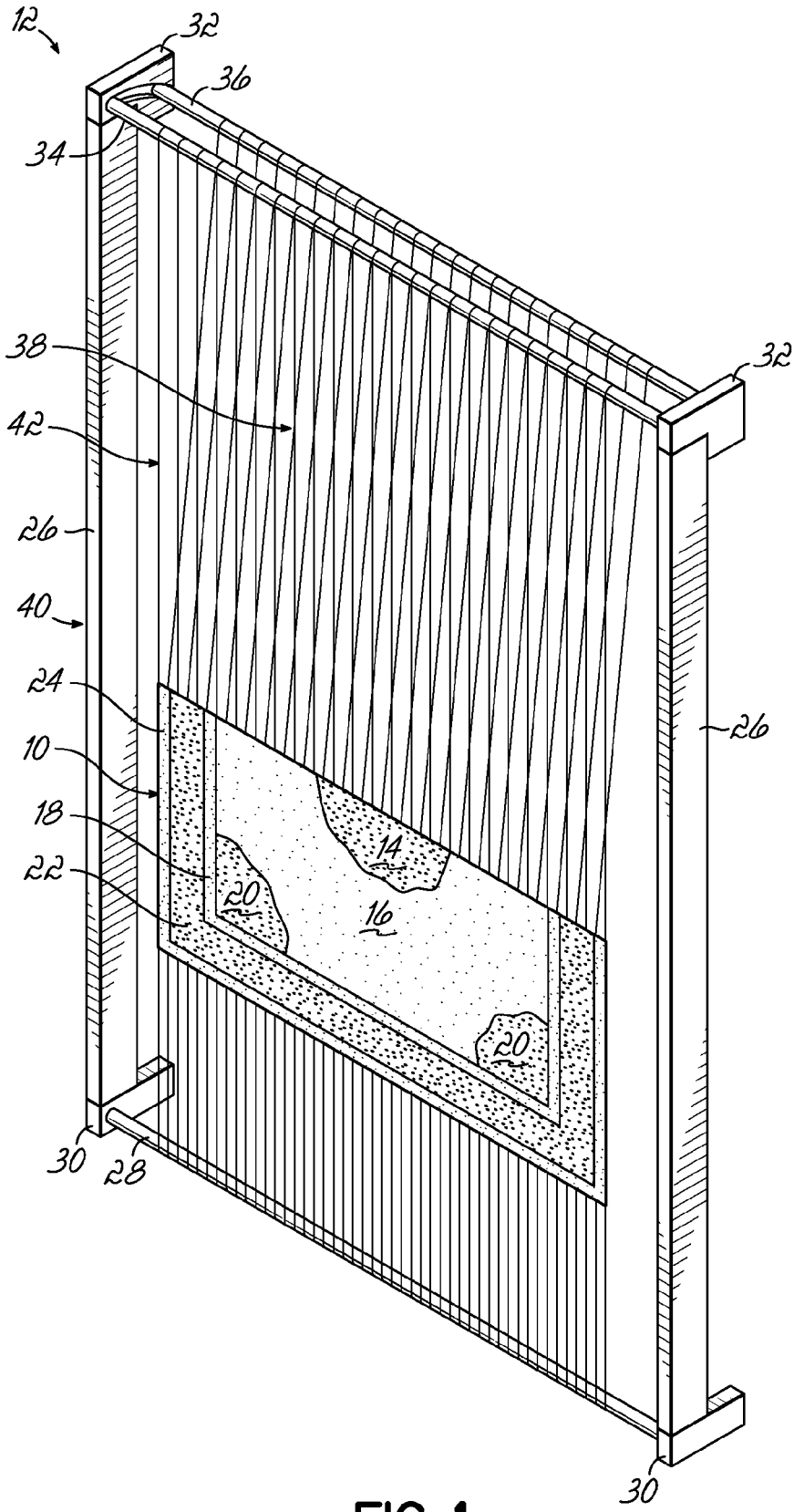
FIG. 1 is a perspective view of an exemplary vertical loom adapted for use according to one embodiment of this invention to weave a rug.

Referring to the drawings and, in particular, FIG. 1, one embodiment of a rug 10 according to this invention is shown being produced on a loom 12 according to an exemplary embodiment of another aspect of this invention. While the rug 10 may take any of a variety of different shapes, configurations, forms or designs, typical rugs include a medallion 14 positioned centrally within a field 16 of the rug 10. The field 16 is commonly bounded by a guard border 18 and may include corner brackets 20 positioned in the corners of the field 16. Surrounding the guard border 18 is a main border 22 which is then bounded by an outer border 24. The rug 10 may include fringe at the longitudinal ends (not shown) or other components well known in the industry.

The loom shown in FIG. 1 according to one aspect of this invention is exemplary only and looms which may be utilized in conjunction with the various aspects of this invention may take any one of a variety of different designs, shapes or configurations. The exemplary loom 12 shown in FIG. 1 is a vertical loom, but a horizontal loom, ground loom, roller loom or any of a variety of other loom types may be utilized. The loom 10 of FIG. 1 includes a pair of spaced generally vertically extending side beams 26. A lower beam 28 extends between a pair of feet 30 supporting the loom 12 on the floor. The feet 30 are positioned at lower ends of the side beams 26. A cap 32 is provided at the upper end of each side beam 26 and, according to one aspect of this invention, a first, forward upper beam 34, as well as a second aft upper beam 36, each extend generally parallel to one another in a spaced relationship between the caps 32 at the upper ends of the side beams. The loom 12 defines a work space 38 for weaving the rug 10 within a frame 40. The upper beams 34, 36 and lower beam 28 define first, second and third frame members, respectively, according to one aspect of the loom 12 according to this invention.

Figure 2:
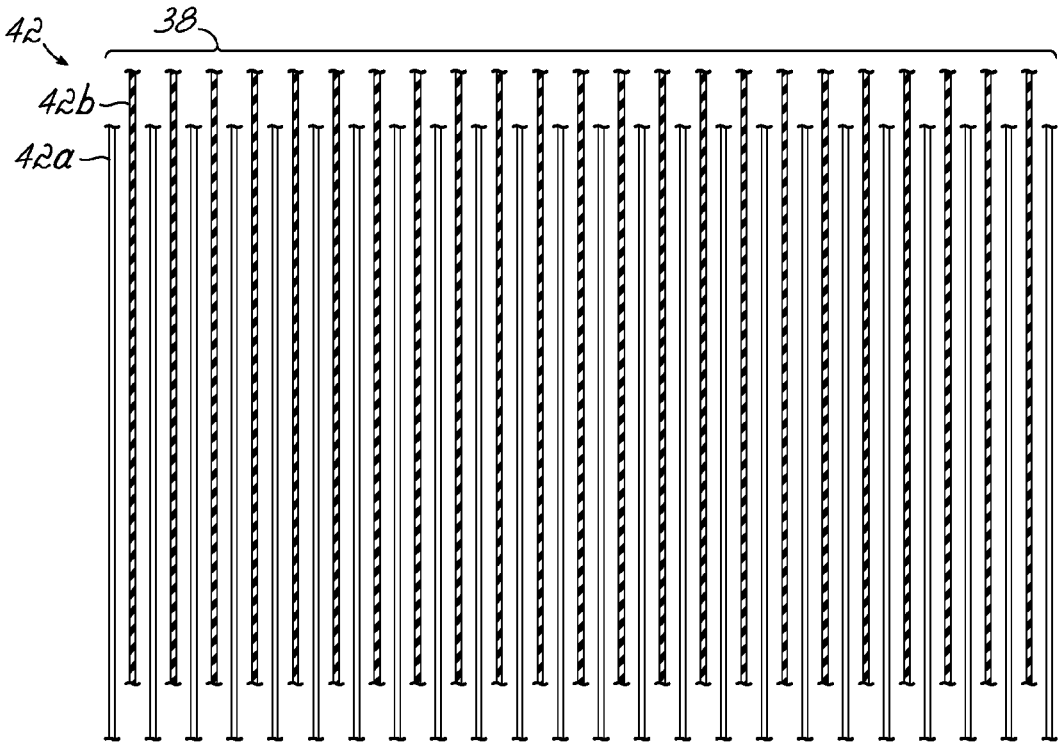
FIG. 2 is a front elevational view of two sets of warp yarns from the loom of FIG. 1 according to one embodiment of this invention.

With continued reference to FIG. 1, a number of warp yarns 42 extend across the work space 38 between the lower beam 28 and the upper beams 34, 36 in a generally longitudinal and vertical direction according to the embodiment shown in FIG. 1. Referring to FIG. 2 in combination with FIG. 1, the warp yarns 42, according to one aspect of this invention, include a first set 42*a* of warp yarns 42 and a second set 42*b* of warp yarns 42. The first set 42*a* of warp yarns 42 extend between the lower beam 28 and the first or forward upper beam 34 and the second set 42*b* of warp yarns 42 extend between the lower beam 28 and the second or aft upper beam 36. The first and second sets of warp yarns 42*a*, 42*b* are distinguished from one another in FIGS. 2-9A as having different cross-hatching or shading characteristics. In one aspect of this invention, each of the yarns of the first set 42*a* of warp yarns 42 alternate in a lateral direction with the warp yarns 42 of the second set 42*b* (FIG. 2). The first and second upper beams 34, 36 are spaced in a direction generally perpendicular to the planar work space 38 and the spacing between the first and second beams 34, 36 may be adjusted within the caps 32 as is appropriate for a particular application or weaving operation.

Figure 3:
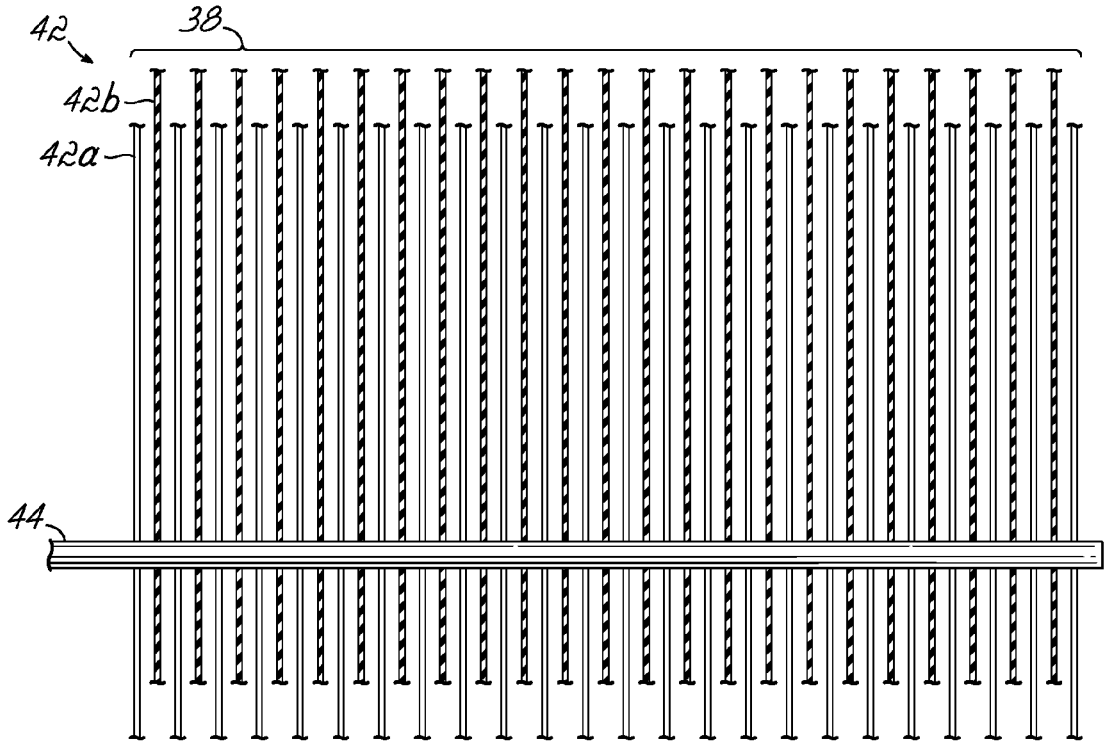
FIG. 3 is a view similar to FIG. 2 with a rod positioned over the warp yarns.
Figure 4:
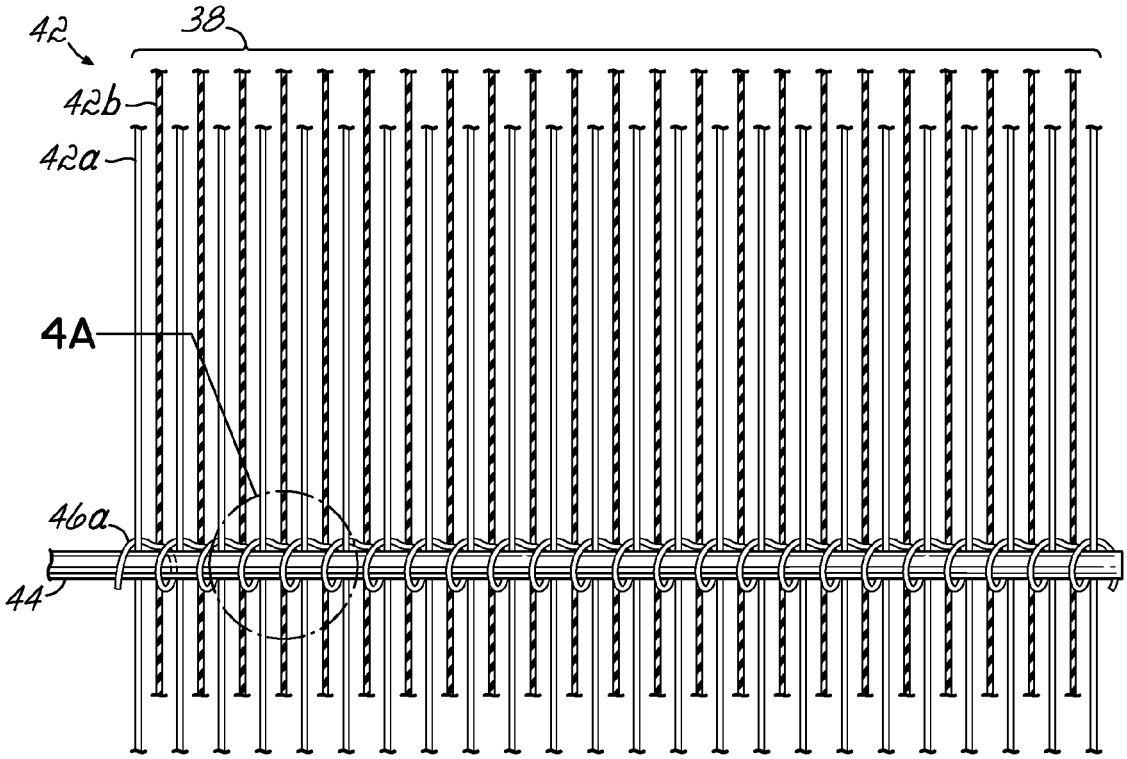
FIG. 4 is a view similar to FIG. 3 with yarn looped around the rod and a first one of the sets of warp yarns for creating a first pile on the first set of warp yarns.
Figure 4A:
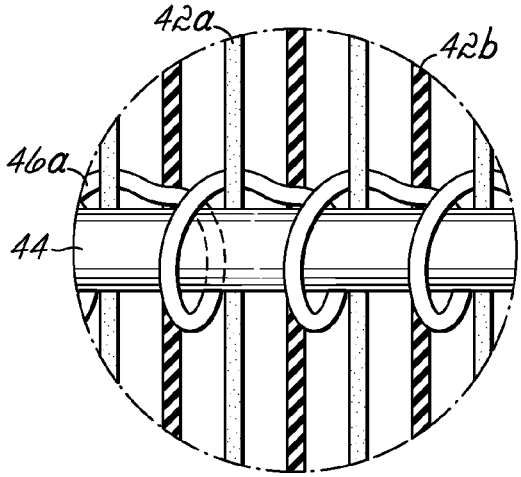
FIG. 4A is an enlarged view of the encircled region 4A on FIG. 4.

One embodiment of a method of weaving a rug 10 according to this invention will now be described, initially with respect to FIG. 3. With the first and second sets 42*a*, 42*b* of warp yarns stretched longitudinally across the work space 38 on the loom 12, a rod 44 is positioned laterally across the warp yarns 42. A first yarn pile thread 46*a* is weaved around the rod 44 and each of the yarns in the first set 42*a* of warp yarns as shown in FIGS. 4 and 4A. The first yarn pile thread 46*a* is weaved around the rod 44 and behind each of the yarns in the first set 42*a* of warp yarns 42 and in front of each of the yarns in the second set 42*b* of warp yarns 42 in one embodiment of this invention (FIG. 4A).

Figure 5:
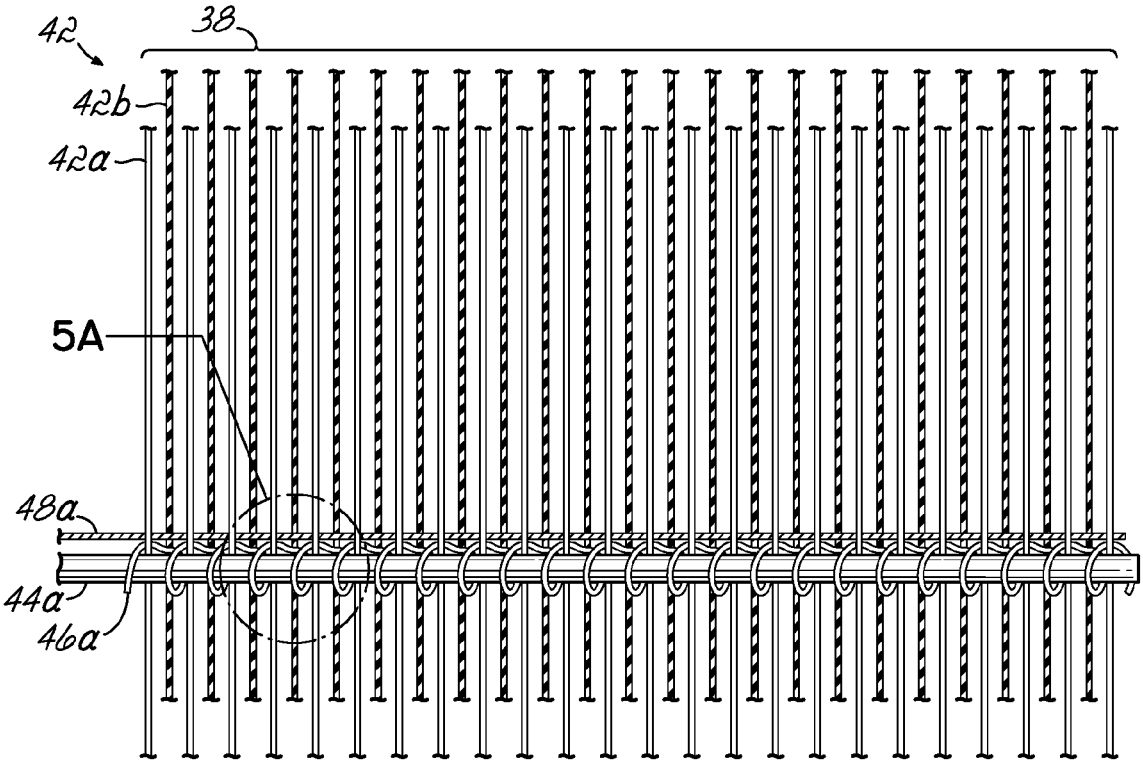
FIG. 5 is a view similar to FIG. 4 with a first weft yarn positioned relative to the rod, yarn pile and sets of warp yarns.
Figure 5A:
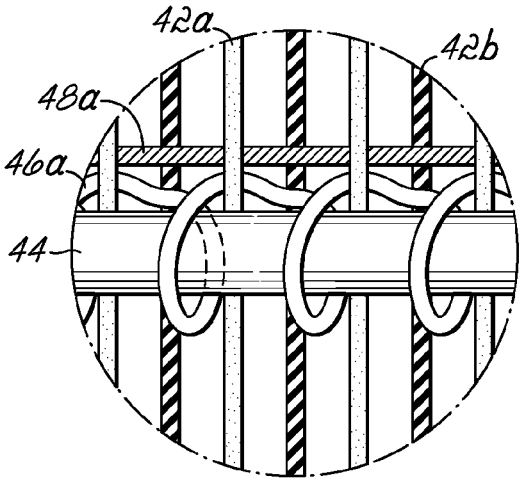
FIG. 5A is an enlarged view of the encircled region 5A on FIG. 5.

Next, a first weft yarn 48*a* is woven laterally through the work space 38 relative to the first and second sets 42*a*, 42*b* of warp yarns such that the first weft yarn 48*a* is behind each of the yarns in the first set 42*a* of warp yarns and in front of each of the yarns in the second set 42*b* of warp yarn as shown in FIGS. 5 and 5A. The first weft yarn 48*a* is beaten or forced downwardly toward the first yarn pile thread 46*a* weaved around the rod 44 as is well known in the art of weaving rugs.

Figure 6:
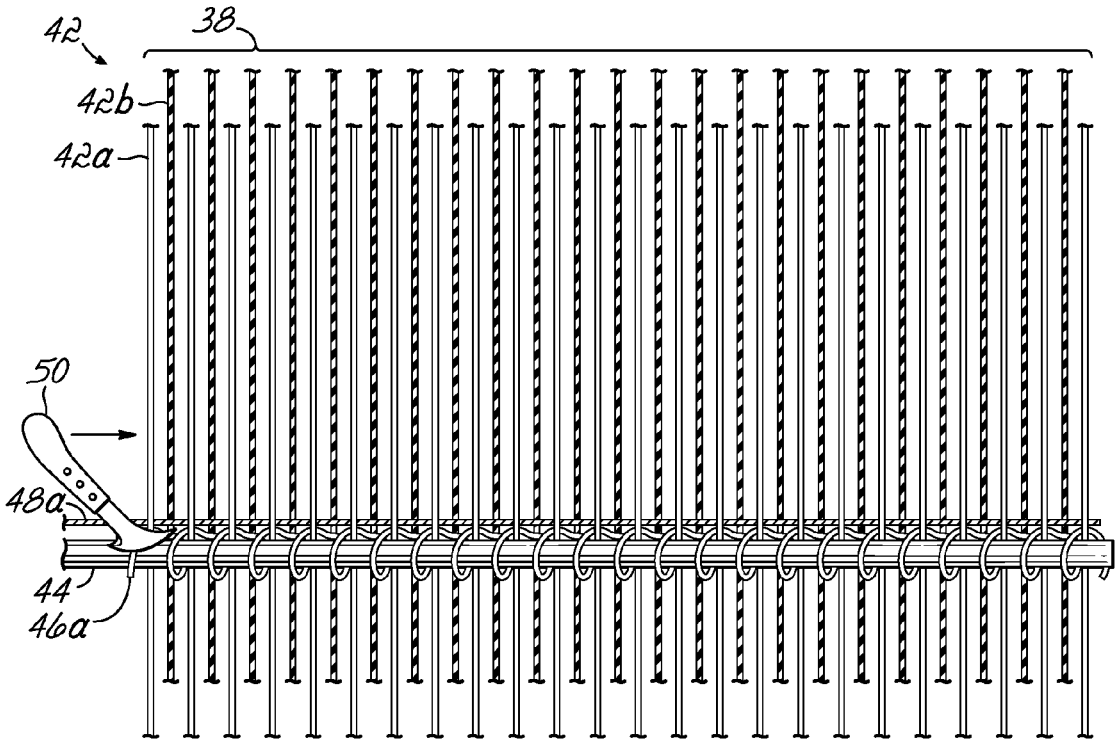
FIG. 6 is a view similar to FIG. 5 with a cutter to sever the yarn pile.
Figure 7:
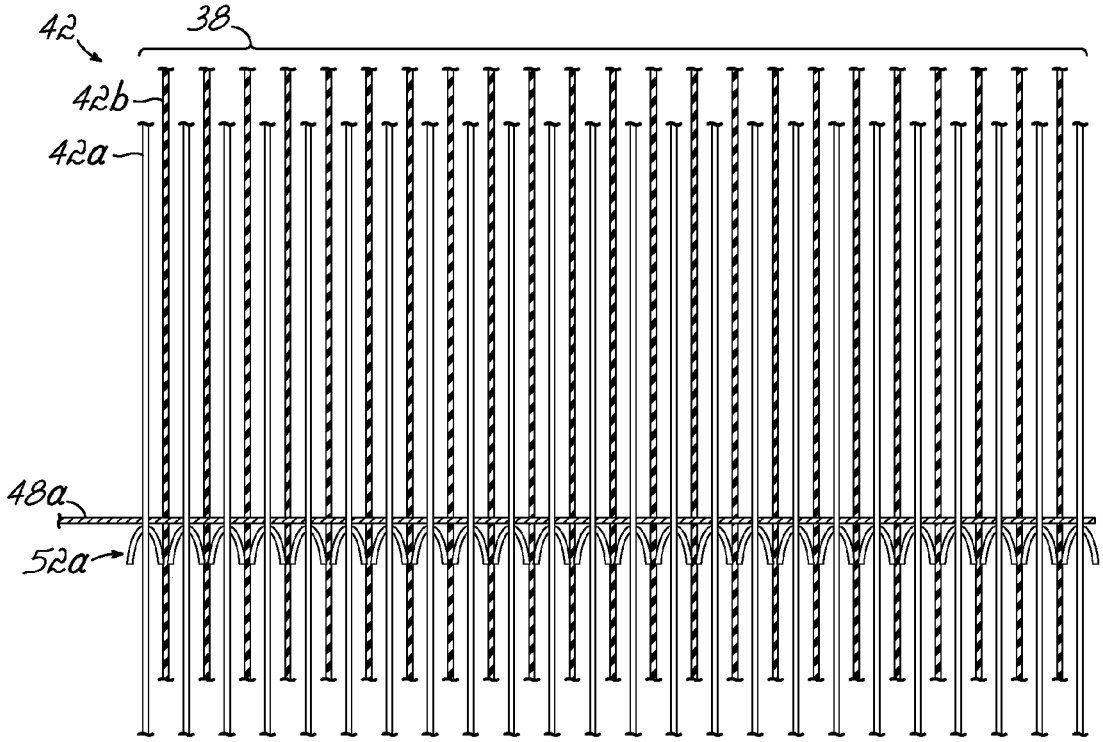
FIG. 7 is a view similar to FIG. 6 with the rod removed and the first yarn pile shown.
Figure 8:
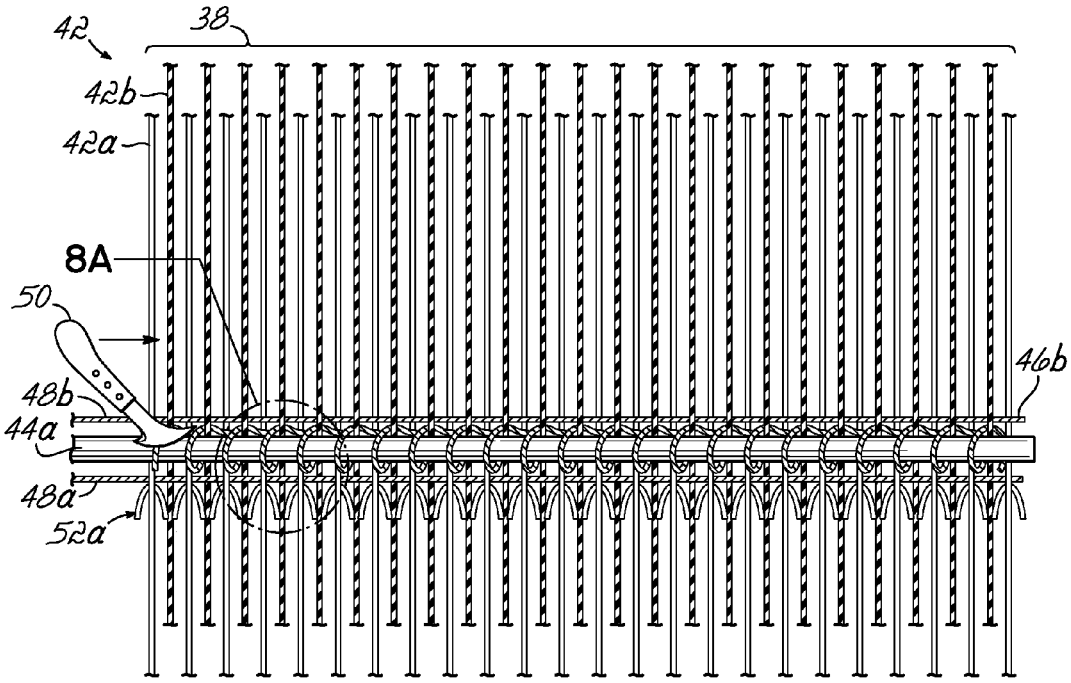
FIG. 8 is a view similar to FIG. 7 with the rod and a second weft yarn positioned relative to the rod and a second yarn pile looped around the rod and a second set of warp yarns for creating a second pile on the second set of warp yarns.

Next, as shown in FIG. 6, the first yarn pile thread 46*a* is cut by a cutter 50 along the rod and, subsequently, the rod 44 is removed. As shown in FIG. 7, a first yarn pile 52*a* is formed in the first set 42*a* of warp yarns 42. The process of one embodiment of this invention for weaving a rug 10 continues by positioning the rod 44 or a different rod 44*a* across the work space 38 as shown in FIG. 8 for formation of a second yarn pile 52*b*. The rod 44, 44*a* used for the creation of the second yarn pile 52*b* may be the same rod as was previously used for the first yarn pile 52*a*, a similar rod of the same geometry and characteristics or a completely different rod with different characteristics such as a larger or smaller diameter to thereby form the second yarn pile 52*b* with a different characteristic than the first yarn pile 52*a*. When the second rod 44*a* is positioned laterally across the work space 38 relative to the first and second sets 42*a*, 42*b* of warp yarns, a second yarn pile thread 46*b* is weaved around the second rod 44*a* and each of the warp yarns 42 in the second set 42*b* as shown particularly in FIGS. 8 and 8A.

Figure 8A:
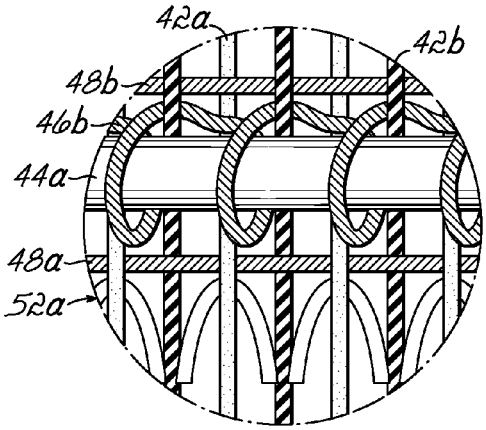
FIG. 8A is an enlarged view of the encircled region 8A on FIG. 8.
Figure 9:
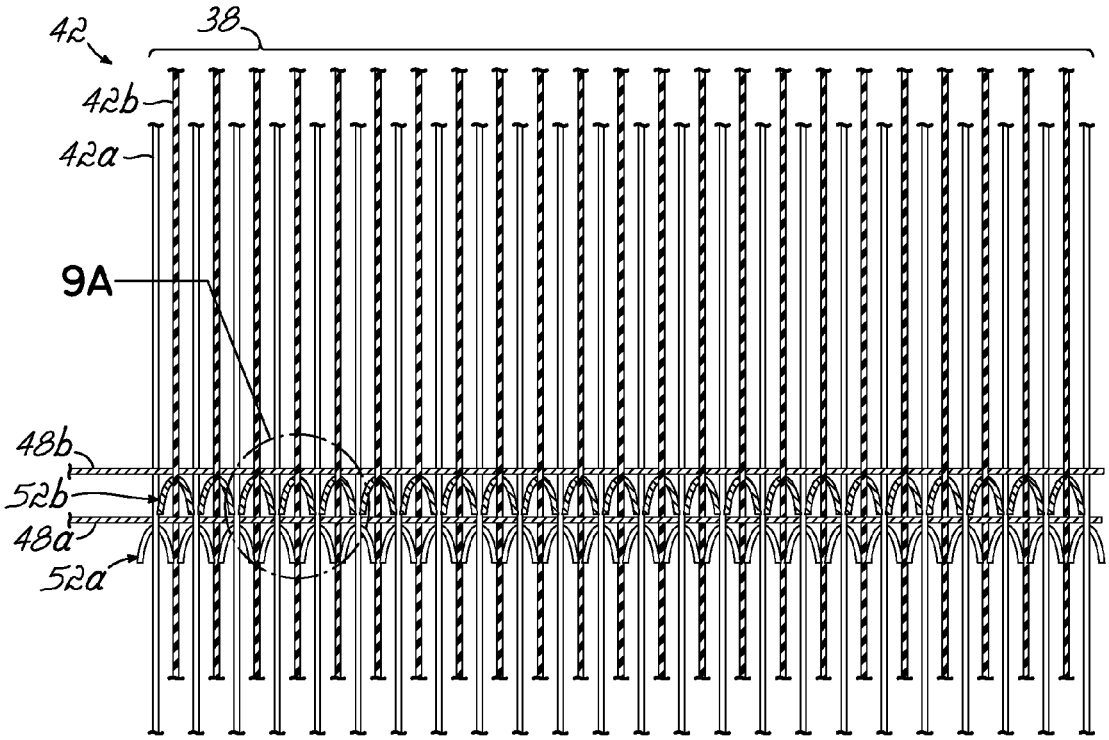
FIG. 9 is a view similar to FIG. 8 with the second yarn pile severed by the cutter to form a second pile on the second set of warp yarns.
Figure 9A:
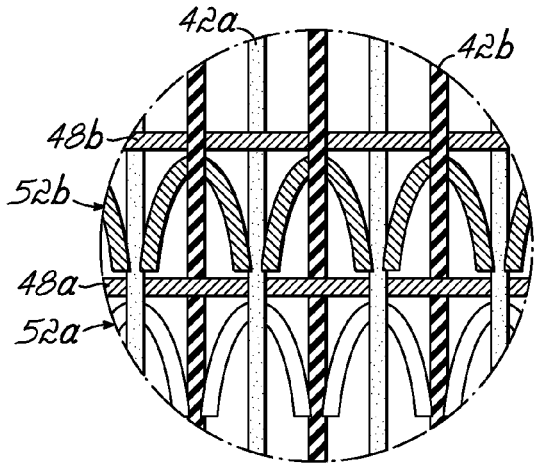
FIG. 9A is an enlarged view of the encircled region 9A on FIG. 9.

After the second yarn pile thread 46*b* is woven around the rod 44*a* and the second set 42*b* of warp yarns, a second weft yarn 48*b* is weaved in the lateral direction across the work space 38 and behind the yarns of the second set 42*b* of warp yarns and in front of the yarns of the first set 42*a* of warp yarns as shown in FIG. 8A. The second weft yarn 48*b* is then forced or beaten down toward the rod 44*a* and the first yarn pile 52*a*. Then the cutter 50 or similar instrument is used to cut the second yarn pile thread 46*b* along the rod 44*a* thereby freeing the second rod 44*a* for removal from the work space 38 and creating a second yarn pile 52*b* on the second set 42*b* of warp yarn threads 42.

This process as described and shown in association with FIGS. 3-9A is then repeated building the yarn piles 52*a*, 52*b* upwardly on the loom 12 as shown in the drawings thereby creating a rug 10 according to one embodiment of this invention. As is well known in the trade, different design characteristics of the rug 10 can be created by utilizing different colors and styles of yarn threads, different rods and other varied characteristics.

Upon completion of the rug 10, the warp yarns 42 are cut from the loom 12 and tied off at the longitudinal ends of the rug 10 thereby producing fringe (not shown) according to one embodiment of this invention.

Figure 10:
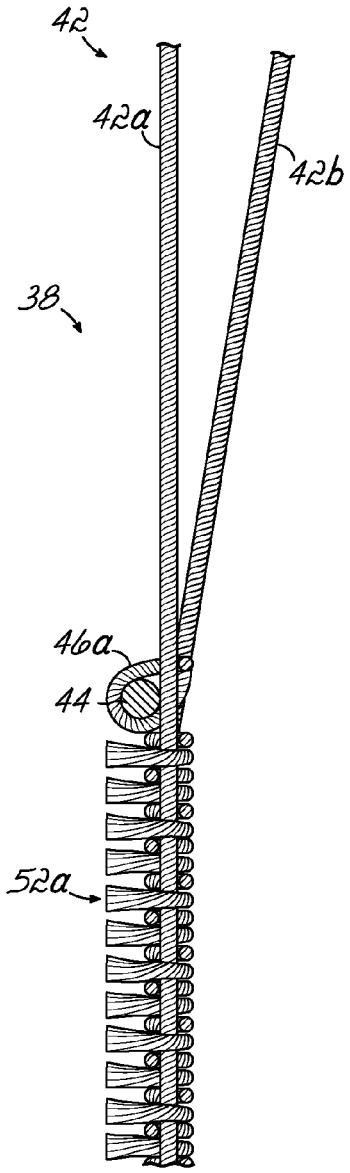
FIG. 10 is a side view of the arrangement shown in FIG. 5 after subsequent weaving has been accomplished.
Figure 12:
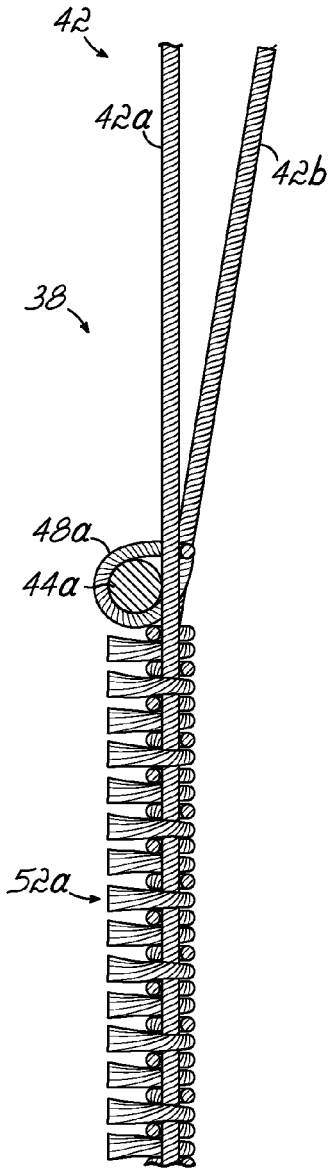
FIG. 12 is a side view of the arrangement shown in FIG. 8 after subsequent weaving has been accomplished.
Figure 13:
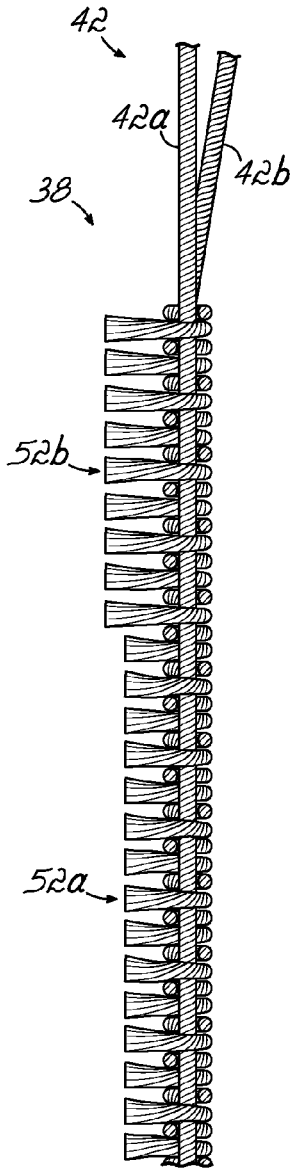
FIG. 13 is a side view similar to FIGS. 10 and 12 after further weaving and showing different pile height regions of the rug.
Figure 11:
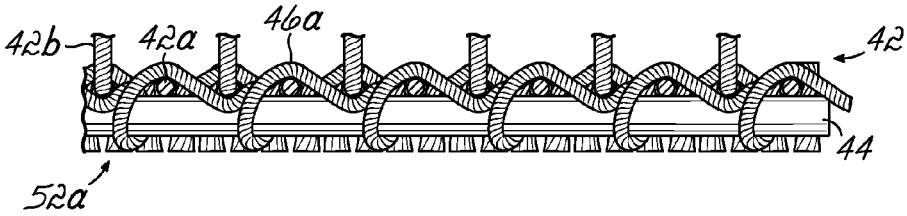
FIG. 11 is a front elevational view of the arrangement shown in FIG. 10.

Referring to FIG. 10, a side elevational view of the rug 10 being woven according to one aspect of this invention is shown with the first rod 44 extending across the warp yarn and in association with the first set 42*a* of warp yarn threads comparable to the arrangement shown in FIG. 4. A front elevational view of the arrangement of FIG. 10 is shown in FIG. 11. Creation of a subsequent second yarn pile 52*b* can be obtained from the arrangement shown in FIG. 12 with a second rod 44*a* having a larger cross-sectional diameter than the first rod 44 of FIGS. 10 and 11. The rod 44*a* of FIG. 12 will produce a deeper yarn pile 52*b* from the rod 44 of FIGS. 10 and 11 as demonstrated in the extended height yarn pile shown in the upper regions of FIG. 13. The shorter pile threads shown in the lower region of FIG. 13 are produced from the rod 44 of FIGS. 10 and 11. This is but one example of the varied characteristics, designs and geometries which can be produced for rugs according to aspects of this invention.

The rug 10 according to any of the embodiments of this invention can be produced to have the look and feel of significantly more expensive rugs produced by highly labor intensive existing weaving techniques. The base or flat woven part of the rug 10 can be either shuttle loomed or produced via a Dhurrie process. These weaves are inexpensive and provide an excellent base for the rug 10.

The desired pattern of the rug 10 according to this invention could be blocked or stenciled onto the flat-woven base of the rug 10. This would give the weaver the location of which color gets tufted where on the rug 10. The patterns can then be hand sheared or left looped depending on the desired design or effect the designer wants to achieve for the rug 10.

Any of the various designs that can be achieved with this invention will produce an embossed or flossed effect. This process would create a similar look to the entirely hand-woven rugs at a reduced price, somewhere about $6.00 to $8.00 per square foot, offering this style of rug have much more mass appeal by being more affordable.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A method of making a rug comprising the steps of:

(a) arranging each of a plurality of first warp yarns in a first set of warp yarns in a longitudinal direction;

(b) arranging each of a plurality of second warp yarns in a second set of warp yarns in the longitudinal direction;

(c) positioning a first rod laterally relative to the first and second sets of warp yarns;

(d) weaving a first yarn pile thread around the first rod and each of the first warp yarns in the first set;

(e) weaving a first weft yarn in a lateral direction adjacent to the first yarn pile thread and relative to the first set of warp yarns;

(f) cutting the first yarn pile thread along the first rod to form a first yarn pile;

(g) positioning a second rod laterally relative to the first and second sets of warp yarns;

(h) weaving a second yarn pile thread around the second rod and each of the second warp yarns in the second set;

(i) weaving a second weft yarn in the lateral direction adjacent to the second yarn pile thread and relative to the second set of warp yarns; and (j) cutting the second yarn pile thread along the second rod to form a second yarn pile;

wherein the method further comprises at least one of the following steps:

(k) weaving the first yarn pile thread behind each of the first warp yarns in the first set of warp yarns and atop each of the second warp yarns in the second set of warp yarns; and (l) weaving the second yarn pile thread behind each of the second warp yarns in the second set of warp yarns and atop each of the first warp yarns in the first set of warp yarns.

2. The method of claim 1 wherein steps (a) and (b) are performed prior to steps (c) thru (j).

3. The method of claim 1 further comprising:

repeating steps (c) thru (j) until the rug is completed.

4. The method of claim 1 wherein steps (c) thru (j) are performed sequentially in the recited order.

5. The method of claim 1 further comprising:

forcing the first weft yarn toward the first yarn pile thread prior to step (f); and forcing the second weft yarn toward the second yarn pile thread prior to step (j).

6. The method of claim 1 wherein step (e) further comprises:

weaving the first yarn pile thread behind each of the first warp yarns in the first set of warp yarns and atop each of the second warp yarns in the second set of warp yarns.

7. The method of claim 1 wherein step (i) further comprises:

weaving the second yarn pile thread behind each of the second warp yarns in the second set of warp yarns and atop each of the first warp yarns in the first set of warp yarns.

8. The method of claim 1 wherein steps (a) and (b) further comprise:

alternating the first warp yarns and the second warp yarns in the lateral direction.

9. The method of claim 1 further comprising:

offsetting the first warp yarns from the second warp yarns in a direction perpendicular to the lateral and longitudinal directions.

10. The method of claim 9 wherein steps (a) and (b) further comprise:

continuously looping a continuous warp yarn around first, second and third members to arrange the first and second sets of warp yarns, wherein the first warp yarns are looped around the first and third members and the second warp yarns are looped around the second and third members.

11. The method of claim 1 wherein a dimension of the first rod is different from a corresponding dimension of the second rod so that the first yarn pile has a different height than the second yarn pile.

12. A method of making a rug comprising the steps of:

(a) arranging each of a plurality of first warp yarns in a first set of warp yarns in a longitudinal direction;

(b) arranging each of a plurality of second warp yarns in a second set of warp yarns in the longitudinal direction; and then (c) positioning a first rod laterally relative to the first and second sets of warp yarns; and then (d) weaving a first yarn pile thread around the first rod and each of the first warp yarns in the first set; and then (e) weaving a first weft yarn in a lateral direction adjacent to the first yarn pile thread and behind each of the second warp yarns in the second set of warp yarns and atop each of the first warp yarns in the first set of warp yarns; and then (f) forcing the first weft yarn toward the first yarn pile thread; and then (g) cutting the first yarn pile thread along the first rod to form a first yarn pile; and then (h) positioning a second rod laterally relative to the first and second sets of warp yarns; and then (i) weaving a second yarn pile thread around the second rod and each of the second warp yarns in the second set; and then (j) weaving a second weft yarn in the lateral direction adjacent to the second yarn pile thread and weaving the second yarn pile thread atop each of the second warp yarns in the second set of warp yarns and behind each of the first warp yarns in the first set of warp yarns; and then (k) forcing the second weft yarn toward the second yarn pile thread; and then (l) cutting the second yarn pile thread along the second rod to form a second yarn pile; and then (m) repeating steps (c) thru (l) until the rug is completed.

13. The method of claim 12 wherein steps (a) and (b) further comprise:

alternating the first warp yarns and the second warp yarns in the lateral direction.

14. The method of claim 12 further comprising:

offsetting the first warp yarns from the second warp yarns in a direction perpendicular to the lateral and longitudinal directions.

15. The method of claim 14 wherein steps (a) and (b) further comprise:

continuously looping a continuous warp yarn around first, second and third members to arrange the first and second sets of warp yarns, wherein the first warp yarns are looped around the first and third members and the second warp yarns are looped around the second and third members.

16. The method of claim 12 wherein a dimension of the first rod is different from a corresponding dimension of the second rod so that the first yarn pile has a different height than the second yarn pile.

* * * * *